United States Patent [19]

Greene

[11] Patent Number: 4,923,621

[45] **Date of Patent: * May 8, 1990**

[54] EXTINGUISHING COMBUSTIBLE METAL FIRES

[75] Inventor: Jay S. Greene, Manheim, Pa.

[73] Assignee: Environmental Security Incorporated, Gloucester, Mass.

[ * ] Notice: The portion of the term of this patent subsequent to Jan. 30, 2007 has been disclaimed.

[21] Appl. No.: 904,279

[22] Filed: Sep. 8, 1986

Related U.S. Application Data

[63] Continuation-in-part of Ser. No. 695,349, Jan. 25, 1985, Pat. No. 4,897,207, and a continuation-in-part of Ser. No. 744,771, Jun. 14, 1985, abandoned.

[51] Int. Cl.[5] ..... A62D 1/00; B01F 17/00; C11D 1/12

[52] U.S. Cl. ..... 252/2; 169/45; 169/47; 252/7; 252/8.05; 252/355; 252/544; 252/554; 252/558; 252/559

[58] Field of Search ..... 252/2, 7, 8, 8.05, 355, 252/DIG. 1; 169/45, 47; 210/749; 239/461

[56] References Cited

U.S. PATENT DOCUMENTS 3,531,407 9/1970 Phillips et al. ..... 252/2
3,565,801 2/1971 Birchall et al. ..... 252/3
3,637,022 1/1972 Kelly (deceased) et al. ..... 252/8.05
4,248,733 2/1981 States, Sr. ..... 252/8.05

FOREIGN PATENT DOCUMENTS 1516977 7/1978 United Kingdom .

OTHER PUBLICATIONS

Hawley, G., ed., 1981, The Condensed Chemical Dictionary, 10th edition, Van Nostrand Reinhold Co., New York, pp. 32–33.

*Primary Examiner*—Howard J. Locker
*Attorney, Agent, or Firm*—Nixon & Vanderhye

[57] ABSTRACT

A Class D (combustible metals) firefighting agent comprises a detergent mixture, vitamin B-6, sodium chloride, bicarbonate soda, and minimum amounts of water. The detergent mixture comprises an alkylbenzolyate sulfonate, non-ionic detergent and lauric superamide, preferably comprising, by volume: about 41–45% linear alkylbenzene sulfonate, about 8–12% isoctylphenyl polyethoxyethanol, about 0–4% polyoxyethylene sorbitan monooleate, about 8–12% lauric diethanolamide, about 0.5–1% monoethanolamide superamides, and about 26–30% water. The vitamin B-6 is provided in an amount of about 1–3% by weight of the detergent mixture, the sodium chloride 25–41%, and the bicarbonate 3–18%. Burning titanium, uranium, or any other type of combustible metal fire, can be extinguished by applying the liquid formulation directly to the fire.

14 Claims, No Drawings

EXTINGUISHING COMBUSTIBLE METAL FIRES

CROSS-REFERENCE TO RELATED APPLICATIONS

This application is a continuation-in-part of applications Ser. Nos. 695,349 filed Jan. 25, 1985, (now U.S. Pat. No. 4,897,207) and 744,771 filed June 14, 1985, (now abandoned).

BACKGROUND AND SUMMARY OF THE INVENTION

Extinguishing Class D fires, that is combustible metal fires, is exceptionally difficult. There were no known liquid firefighting agents prior to the invention which are capable of extinguishing Class D fires. According to the invention, it is possible to extinguish burning metal fires since the formulation according to the invention is capable of absorbing a tremendous amount of heat without turning into a gas and separating as other liquid agents do when they come in contact with burning combustible metals. For the formulation according to the invention, the heat absorption ability is approximately 7.7 million BTUs per pound, compared to 1,142 BTUs per pound for water. It may be applied with any standard mobile or fixed firefighting equipment utilizing a wide angle fog nozzle, or sprinkler system head.

The liquid formulation for use as a Class D firefighting agent according to the invention consists essentially of a mixture of: A linear alkylbenzene sulfonate, non-ionic detergent and lauric superamide detergent mixture comprising about 39–67 percent of the total mass of the formulation. Vitamin B-6 in the amount of 1–3 percent by weight of the detergent mixture. Sodium chloride in the amount of about 25–41 percent by weight of the detergent mixture. Bicarbonate of soda in the amount of about 3–18 percent by weight of the detergent mixture. 0–4 percent by weight of the detergent mixture coloring and perfuming agents. And, a volume of water large enough only to provide effective mixing of the other components of the formulation and insufficiently large to interfere with the use of the formulation as an effective Class D firefighting agent. The detergent mixture component of the formulation preferably comprises, by volume: about 41–45% linear alkylbenzene sulfonate (LAS), about 8–12% isooctylphenyl polyethoxyethanol (IP), about 0–4% polyoxyethylene sorbitan monooleate (PSM), about 8–12% lauric diethanolamide (LD), about 0.5–1% monoethanolamide superamides (MS), and about 26–30% water. In a preferred formulation according to the invention vitamin B-6 is in an amount of about 1%, bicarbonate about 8%, and sodium chloride about 37%.

The invention also comprises a method of formulating the Class D liquid firefighting agent according to the invention, and extinguishing a combustible metal fire. In the method of formulating a Class D firefighting agent, the following steps are practiced: adding amounts of materials consisting essentially of vitamin B-6, sodium chloride, and bicarbonate of soda, with small amounts of coloring and perfuming agents if desired, effective when, in formulation, to put out a Class D fire, to a minimum amount of water sufficient to facilitate mixing of the components; mixing the vitamin B-6, sodium chloride, bicarbonate of soda, and water together so that substantially no lumps exist and a generally homogeneous slurry is provided; and then mixing the slurry with the detergent mixture so as to provide a homogeneous Class D firefighting agent.

A method of extinguishing a combustible metal fire according to the invention comprises the following step applying directly to the fire a liquid composition consisting essentially of a major part of detergent mixture of linear alkylbenzolyate sulfonate, non-ionic detergent and lauric superamide, and amounts of vitamin B-6, sodium chloride, bicarbonate of sodium, with minimal amounts of water, with small amounts of coloring and perfuming agents, if desired, effective when, in formulation, to put out a combustible metal fire, by slowing down the detergent mixture emulsification rate; densifying and increasing the heat absorption capability of the detergent mixture; agitating and stabilizing the detergent mixture; and densifying and preventing separation and detonation of the detergent mixture when exposed to burning metal.

It is the primary object of the present invention to provide an effective Class D firefighting liquid composition, and method of formulation and fire extinguishment utilizing the same. This and other objects of the invention will become clear from the detailed description, and the appended claims.

DETAILED DESCRIPTION

The basic ingredient of the liquid firefighting formulation according to the invention is a detergent mixture comprising a linear alkylbenzene sulfonate, non-ionic detergent and lauric superamide detergent mixture. In the preferred embodiment that mixture comprises about 39–67% of the total mass of the formulation. It has been found particularly effective if the detergent comprises, by volume: about 41–45% linear alkylbenzene sulfonate, about 8–12% isooctylphenyl polyethoxyethanol, about 0–4% polyoxyethylene sorbitan monooleate, about 8–12% lauric diethanolamide, about 0.5–1% monoethanolamide superamides, and about 26–30% water.

The formulation according to the invention also preferably comprises vitamin B-6 in an amount of about 1–3%, with about 1% being optimum, by weight of the detergent mixture. The vitamin B-6 acts as a densifier and increases the heat absorption capability of the detergent, mixture.

The liquid composition according to the invention also preferably comprises sodium chloride as a significant component thereof. Sodium chloride typically comprises about 25–41% by weight of the detergent mixture, with about 37% being optimum. Sodium chloride densifies the detergent mixture, and prevents it from separating and detonating in Class D fires. It partially dissolves in the detergent mixture down to the molecular level, and will not itself cause detonation. Other commonly-recognized Class D agents are not effective, nor are other salts such as potassium chloride (e.g. potassium will burn when exposed to a burning combustible metal).

Another significant component of the preferred liquid composition according to the invention is bicarbonate of soda. The bicarbonate of soda is typically provided in the amount of about 3–18% by weight of the detergent mixture, with about 8% being optimum. The bicarbonate of soda agitates the detergent mixture so that it suds more quickly, and acts as a stabilizer, and helps prevent burn-through.

The liquid composition according to the invention also requires the use of some water in order to provide effective mixing of the other constituents. However, the amount of water is minimized since water will cause the agent to be less effective and may cause separation or detonation. Only enough water is added to the components, besides the detergent mixture, so that they can be mixed properly prior to addition to the detergent mixture during production of the liquid formulation.

Non-toxic and low flammability, coloring and perfuming agents may be added so that the liquid formulation does not have an objectionable appearance or odor. The most suitable coloring material is standard vegetable color,-and the best known perfuming agent is eucalyptus oil. These materials are typically added so that their combined total contribution to the liquid formulation is less than about 4% by weight of the detergent mixture.

In the method of formulating the Class D liquid firefighting agent according to the invention, effective amounts of vitamin B-6, sodium chloride, and bicarbonate of soda are added to a minimum amount of water sufficient to facilitate mixing of the components. Then the vitamin B-6, sodium chloride, and bicarbonate of soda and water are mixed together so that substantially no lumps exist and a generally homogeneous slurry is provided. Then the slurry is mixed with the detergent mixture so as to provide a homogeneous liquid combustible metals firefighting agent.

In extinguishing a combustible metal fire utilizing the agent according to the invention, it is applied at essentially 100% concentration. If water is added, it will decrease effectiveness and may cause separation and detonation. It is applied at a system pressure desirably no less than 50 pounds per square inch, and preferably within the range of about 50–200 pounds per square inch It is desirably not applied with a straight stream nozzle as the pressure of any stream against the combustible metal tends to cause hot metal fragments to be dispersed in all directions. It is best applied with a wide angle fog nozzle, or existing sprinkler systems which have heads which will break up the liquid stream into a dispersed pattern.

The Class D firefighting agent according to the invention is capable of fighting all combustible metal fires. For example it can extinguish titanium, magnesium, zerconium, graphite, and uranium fires. Even if the metals are radioactive (such as uranium, plutonium, or graphite which has become radioactive due to close contact over a long period of time with uranium, plutonium, or the like), the agent is effective to extinguish the fire within a short period of time.

EXAMPLE

A Class D firefighting liquid composition was formulated by mixing 8.25 pounds of detergent mixture with other components. One percent by weight eucalyptus oil, 1% by weight vitamin B-6, 37% by weight sodium chloride, and 8% by weight bicarbonate of soda were mixed with a minimum amount of water, only enough to provide effective mixing of the components. The amount of water sufficient to do this would typically be about 3–7% by weight, with mixing taking place until there are no lumps. The detergent mixture and 0.5% by weight vegetable color are then added to the other components, and mixing continues until a homogeneous product is produced. This product is then suitable for direct application to Class D fires by spraying in on the fires with a fog nozzle, or the like. Utilizing this liquid composition as a firefighting agent, the following test was conducted:

TEST SET UP

Titanium powder (99.8 min) was placed on a 6 square foot steel plate in an 8 foot pit. The depth of the titanium ranged from 2 to 2.5 inches. The test was conducted in the pit to reduce the possibility of agent splashing upon application. Then a small quantity of magnesium was blended with the titanium powder. Next, the powder mixture was saturated with gasoline. The magnesium and gasoline were added to act as accelerants upon ignition of the titanium powder.

Test Procedure

A torch was applied to the powder mixture described in the test set up. The metal mixture was allowed to burn for 7.5 minutes (pre-burn). After 7.5 minutes the subject agent was applied to the metal fire by an Akron turbo-jet nozzle rated at 30 gal/min and a pressure of 100 psig. This first application, consumed 15 gallons of agent. At this point the metal surface fire was not completely covered. An additional 5 gallons of agent was applied approximately 5 minutes later so that the metal was completely engulfed in agent.

Observations

The following observations were made after the second application of agent at the time intervals listed below.

15 minutes - Agent was adhering to the metal surface. The agent at the center of the pit was bubbling. No signs of fire.

30 minutes - Some bubbling of the agent still visible. No signs of fire.

45 minutes - Test personnel concluded that the fire was completely extinguished, no signs of bubbling or fire. The agent was removed from the test pit, the remaining titanium powder appeared caked. In order to reach the core of the metal the outside surface had to be chipped away. Upon reaching the core, it was observed that the core temperature was less than the ambient temperature of the pit.

It was concluded that the titanium fire was extinguished and the temperature of the titanium was low enough not to warrant re-ignition.

While of course small amounts of contaminants are tolerable, with no adverse affect on the ability of the firefighting agent according to the invention to extinguish combustible metal fires, it is desirable that the agent consist essentially of the detergent mixture, vitamin B-6, sodium chloride, bicarbonate of soda, a minimal amount of water, and small amounts of non-toxic and low flammability perfuming and coloring agents.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent formulations and procedures.

What is claimed is:

1. A liquid formulation for use as a Class D firefighting agent and consisting essentially of a mixture of:

a linear alkylbenzene sulfonate, non-ionic detergent and lauric superamide detergent mixture comprising about 39–67 percent of the total mass of the formulation;

vitamin B-6 in the amount of 1–3 percent by weight of the detergent mixture;

sodium chloride in the amount of about 25–41 percent by weight of the detergent mixture;

bicarbonate of soda in the amount of about 3–18 percent by weight of the detergent mixture;

0–4 percent by weight of the detergent mixture coloring and perfuming agents; and a volume of water large enough only to provide effective mixing of the other components of the formulation and insufficiently large to interfere with the use of the formulation as an effective Class D firefighting agent.

2. A method of formulating a Class D liquid firefighting agent which includes a detergent mixture comprising an alkylbenzene sulfonate, non-ionic detergent and lauric superamide, comprising the steps of:

adding amounts of materials consisting essentially of vitamin B-6, sodium chloride, and bicarbonate of soda, with small amounts of coloring and perfuming agents if desired, effective when, in formulation, to put out a Class D fire, to a minimum amount of water sufficient to facilitate mixing of the components;

mixing the vitamin B-6, sodium chloride, bicarbonate of soda, and water together so that substantially no lumps exist and a generally homogeneous slurry is provided; and then mixing the slurry with the detergent mixture so as to provide a homogeneous Class D firefighting agent.

3. A method of extinguishing a combustible metal fire comprising the steps of:

applying directly to the fire a liquid composition consisting essentially of a major part of detergent mixture of linear alkylbenzene sulfonate, non-ionic detergent and lauric superamide, and amounts of vitamin B-6, sodium chloride, bicarbonate of sodium, with minimal amounts of water, and with small amounts of coloring and perfuming agents, if desired, effective when, in formulation, to put out a combustible metal fire, by slowing down the detergent mixture emulsification rate; densifying and increasing the heat absorption capability of the detergent mixture; agitating and stabilizing the detergent mixture; and densifying and preventing separation and detonation of the detergent mixture when exposed to burning metal.

4. A method as recited in claim 3 wherein in the liquid composition the detergent mixture comprises about 39–67% of the total mass; and wherein the other components consist essentially of: vitamin B-6 in an amount of about 1–3% by weight of the detergent mixture; sodium chloride in an amount of about 25–41% by weight of the detergent mixture; and bicarbonate of soda in an amount of about 3–18% by weight of the detergent mixture; with small amounts of non-toxic, relatively low flammability, coloring and perfuming agents as desired.

5. A method as recited in claim 4 wherein the detergent mixture portion of the liquid composition comprises, by volume, about 41–45% linear alkylbenzene sulfonate, about 8–12% isooctylphenyl polyethoxyethanol, about 0–4% polyoxyethylene sorbitan monooleate, about 8–12% lauric diethanolamide, about 0.5–1% monoethanolamide superamides, and about 26–30% water.

6. A formulation as recited in claim 1 wherein the detergent mixture component of the formulation comprises, by volume: about 41–45% linear alkylbenzene sulfonate, about 8–12% isooctylphenyl polyethoxyethanol, about 0–4% polyoxyethylene sorbitan monooleate, about 8–12% lauric diethanolamide, about 0.5–1% monoethanolamide superamides, and about 26–30% water.

7. A method of formulating a Class D firefighting agent as recited in claim 2 wherein the detergent mixture component of the resulting formulation comprises, by volume: about 41–45% linear alkylbenzene sulfonate, about 8–12% isooctylphenyl polyethoxyethanol, about 0–4% polyoxyethylene sorbitan monooleate, about 8–12% lauric diethanolamide, about 0.5–1% monoethanolamide superamides, and about 26–30% water.

8. A formulation as recited in claim 1 wherein bicarbonate of soda is provided in the amount of about 8%. vitamin B-6 in the amount of about 1%, and sodium chloride in the amount of about 37%.

9. A method as recited in claim 2 wherein the step of mixing the vitamin B-6, sodium chloride, and bicarbonate of soda and mixing the slurry with the detergent mixture is practiced so that for the final Class D firefighting agent produced the vitamin B-6 comprises about 1–3% by weight of the detergent mixture, the sodium chloride comprises about 25–41% by weight of the detergent mixture, and the bicarbonate of soda comprises an amount of about 3–18% by weight of the detergent mixture.

10. A method as recited in claim 9 wherein the amounts of vitamin B-6, sodium chloride, and bicarbonate of soda in the final firefighting agent comprise about 1% vitamin B-6, about 8% bicarbonate of soda, and about 37% sodium chloride.

11. A method as recited in claim 4 wherein the amounts of vitamin B-6, sodium chloride, and bicarbonate of soda in the final firefighting agent comprise about 1% vitamin B-6, about 8% bicarbonate of soda, and about 37% sodium chloride.

12. A method as recited in claim 5 wherein the amounts of vitamin B-6, sodium chloride, and bicarbonate of soda in the final firefighting agent comprise about 1% vitamin B-6, about 8% bicarbonate of soda, and about 37% sodium chloride.

13. A formulation as recited in claim 8 wherein the detergent mixture component of the formulation comprises, by volume about 41–45% linear alkylbenzene sulfonate, about 8–12% isooctylphenyl polyethoxyethanol, about 0–4% polyoxyethylene sorbitan monooleate, about 8–12% lauric diethanolamide, about 0.5–1% monoethanolamide superamides, and about 26–30% water.

14. A method of formulating a Class D firefighting agent as recited in claim 9 wherein the detergent mixture component of the resulting formulation comprises, by volume: about 41–45% linear alkylbenzene sulfonate, about 8–12% isooctylphenyl polyethoxyethanol, about; 0–4% polyoxyethylene-sorbitan monooleate, about 8–12% lauric diethanolamide, about 0.5–1% monoethanolamide superamides, and about 26–30% water.

* * * * *